United States Patent [19]

Studebaker

[11] 4,120,073

[45] Oct. 17, 1978

[54] DETACHABLE HOLDER FOR BEVERAGE CANS

[76] Inventor: Robert L. Studebaker, 5732 S. Evanston Pl., Tulsa, Okla. 74105

[21] Appl. No.: 781,038

[22] Filed: Mar. 24, 1977

[51] Int. Cl.[2] ..... A45J 45/07; B65D 23/10; B65D 25/28

[52] U.S. Cl. ..... 16/114 R; 294/27 H; 294/33

[58] Field of Search ..... 16/114 R, 114 A; 294/27 H, 33, 99 R; D7/99; 24/255 R

[56] References Cited

U.S. PATENT DOCUMENTS

| | | | |
|---|---|---|---|
| D. 233,118 | 10/1974 | Finn | 294/33 |
| D. 236,410 | 8/1975 | Jenkins | 294/27 H |
| 2,029,051 | 1/1936 | Blevins | 294/33 |
| 2,783,077 | 2/1957 | Pierce | 294/33 |
| 2,926,038 | 2/1960 | Hyams | 294/33 |
| 3,189,937 | 6/1965 | Sciortino | 16/114 A |
| 3,409,207 | 11/1968 | Eicholtz et al. | 294/33 X |

*Primary Examiner*—Louis K. Rimrodt
*Attorney, Agent, or Firm*—Laurence R. Brown

[57] ABSTRACT

A detachable holder for beverage cans, such as soft drink or beer cans, having external end flanges, chimes or rims that is injection molded from synthetic plastic and includes a hand gripping portion of generally U-shaped cross-section, including upper and lower legs and resilient arcuate can engaging clips extending from the legs. The hand gripping portion has finger accommodating recesses in the side adjacent a can to be held and the upper surface of the upper leg is inclined upwardly away from the chime engaging shoulder to a top portion disposed well above the plane of the top of a can to be held.

3 Claims, 6 Drawing Figures

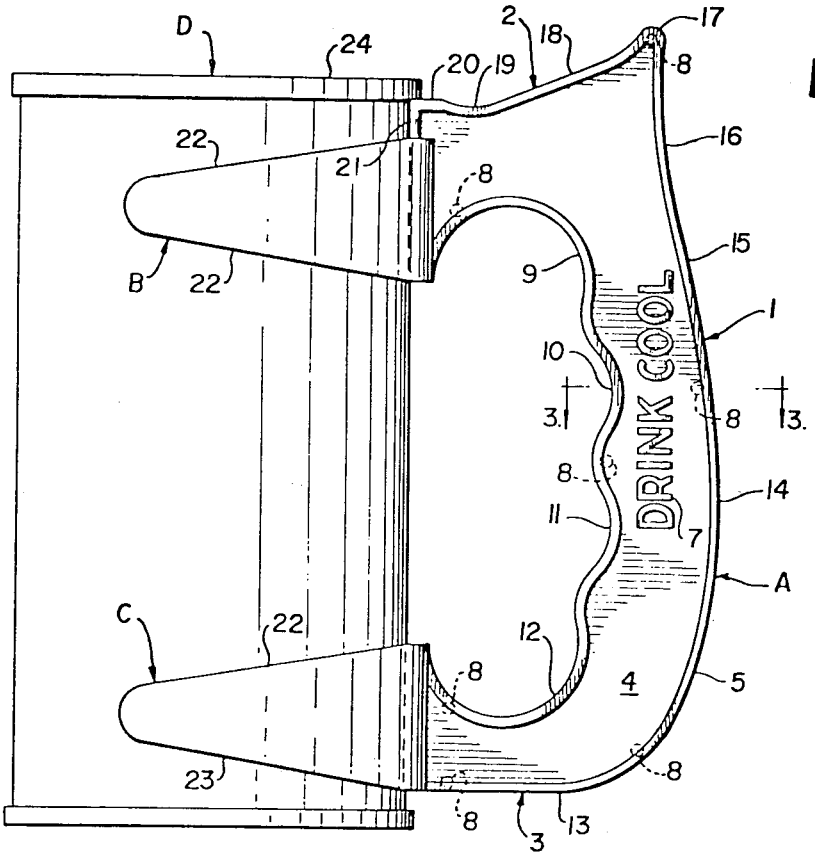
FIG.1
FIG.3
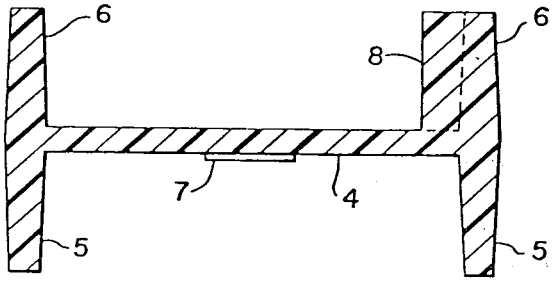
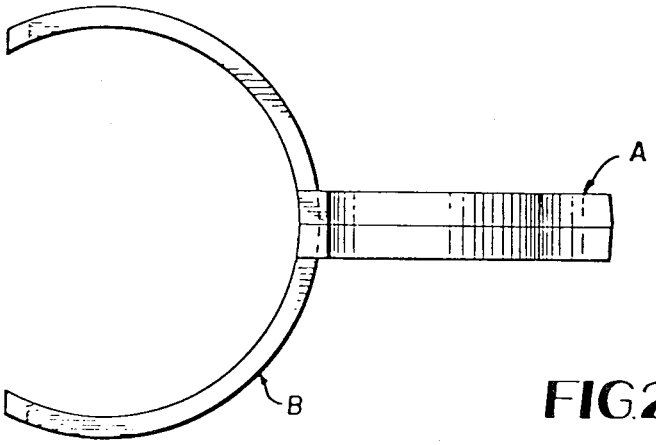
FIG.2

DETACHABLE HOLDER FOR BEVERAGE CANS

BACKGROUND OF THE INVENTION

The present invention relates broadly to the art of handles and more particularly it relates to a detachable handle or holder for beverage and the like cans.

The prior art is replete with holding devices or detachable handles that can be removably associated with cans, bottles, jars and the like to facilitate drinking the contents thereof. Examples of such devices are shown in U.S. Pat. No. 2,029,051 to A. C. Blevins and U.S. Design Pat. No. 159,292 to A. V. Olson.

Both of the above prior disclosures embody upper and lower resilient clips for engaging a container and a handle portion interconnecting the clips so that the holding device can be detachably associated with a container such as a bottle, can or the like.

The prior art devices generally embody metallic clips removably connected with a handle member although it is known to construct a holding device from wire in which the clips are integral with the handle member. Further the Blevins patent indicates that the upper and lower clips can be formed integrally with the handle.

However, it is desirable that a detachable handle device be provided that is of plastic material, molded into a one-piece construction that includes spaced resilient clip members and a hand gripping portion. The device to be so constructed and arranged that it is economical to produce, sufficiently rugged to withstand long wear, is particularly adapted for association with conventional cans such as beer or soft drink cans having upper and lower external flanges or ribs thereon and embodies features that facilitate the gripping thereof and the use thereof in pouring or dispensing the contents from the can with which the device is associated. Thermal insulation is thus assured.

Accordingly, the present invention provides a device that is injection molded from synthetic plastic material such as polyethylene, includes a generally U-shaped hand-gripping portion, integral upper and lower resilient, arcuate or segmental resilient can engaging clips extending from the legs of the U-shaped hand gripping portion to snap-fit around a can and an integral upstanding shoulder on one of the legs of the hand-gripping portion for engagement beneath the upper flange or lip on a can to be held.

Further, the invention provides an arrangement in which the hand-gripping portion is of I-beam cross-section to provide strength and the flange to be facing the can in use includes finger engaging depressions on the surface thereof.

In addition the arcuate or segmental can engaging clips are inwardly tapered in side elevation from the hand-gripping portion toward the free ends thereof so as to develop a proper grip on the can.

As another aspect the upper leg of the hand-gripping portion of the invention has its upper surface inclined upwardly away from the can to be held to merge into a tip portion located sufficiently above the plane of the top rim of a can as to facilitate gripping of the holder by a thumb during drinking use and when pouring or dispensing the contents from a can.

As an added feature the flanges of the I-beam cross-section of the hand-gripping portion project substantially beyond the web thereof so that the web faces provide recessed surfaces that can receive advertising matter or indicia applied thereto or formed thereon during molding.

Further and more specific features and advantages of the present invention will be more readily apparent from the following description when taken in connection with the accompanying drawings in which:

FIG. 1 is a side elevational view of the can holder of the invention with a portion of a can being shown in dotted lines;

FIG. 2 is a top plan view of the can holder structure shown in FIG. 1;

FIG. 3 is a cross-sectional view on an enlarged scale taken along line 3—3 of FIG. 1;

Figure 4:
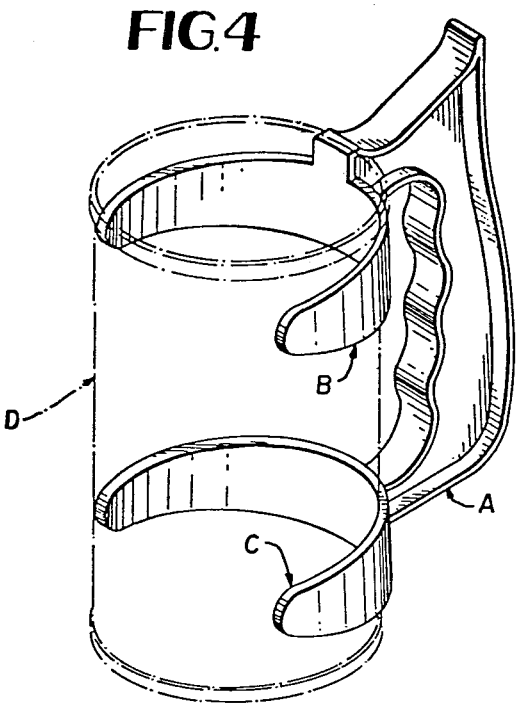
FIG. 4 is a perspective view of the can holder of the invention as applied to a beverage can, the latter being shown in dotted lines; and, FIGS. 5 and 6 are fragmentary views illustrating a users finger and thumb relationship with the upper portion of the holder during different grippings of the holder.

As illustrated in the drawings, the detachable handle or holder for beverage cans of this invention includes a hand-gripping portion A and upper and lower can engaging clip portions B and C to engage a can D. The holder is molded, preferably injection molded from a synthetic plastic, such as polyethylene so as to provide an integral shaped structure. In general the size of the holder is related to the size of standard beverage cans now in use. It is to be understood however, that the size of the portions A, and B and C can be varied to accommodate different size cans.

The hand-gripping portion A is generally U-shaped in side elevation and includes a hand accommodating base or upright 1 and upper and lower legs 2 and 3. The hand-gripping portion is of I-beam cross-section to provide strength and a certain amount of flexibility and has a central web portion 4 and oppositely extending flange portions 5 and 6. As illustrated the flange portions project outwardly of the web portion several times the thickness of the web portion so that the surface area of the web portion can receive advertising media or other indicia such as at 7 either applied thereon or molded to therewith during formation of the holder, since the advertising is recessed, it is protected and it may assume several forms, such as raised letters or pictures or added decals or printed material.

Also, during molding strengthening ribs are formed at appropriate locations along at least one of the flange portions. These ribs or beads are shown at 8. If desired they could extend along both flange portions.

The outer surfaces of the inner portions of flanges 5 and 6 have arcuate portions as at 9, 10, 11 and 12 to provide finger engaging recesses. The outer surfaces of the outer portions of these flanges 5 and 6 include a straight portion 13 on leg 3, a curved upright portion 14, a reversely curved portion 15 opposite a part of arcuate portion 9 and a further gently curved portion 16 leading to a tip 17. The tip 17 is well above the plane of the top of a can to be gripped. Leading downwardly from the tip 17, the flange surfaces are inclined downwardly at 18, gently curved upwardly at 19 and extended horizontally to form a can rim engaging surface 20. The flanges then extend downwards at 21 to merge with the upper surface of upper can engaging clip B.

The can engaging clips B and C are arcuate or segmental and have an inner radius substantially equal to but slightly less than that of a can D to be gripped and an extent to encompass more than one hundred eighty degrees of the container. As shown, these clip portions have their upper and lower surfaces tapered inwardly as at 22 and 23 from the hand-gripping portion to their outer ends. This relationship combined with the resiliency of the plastic material from which the device is made ensure a snap-fit positive grip on a can when the holder is grasped in either hand and moved toward a can. As shown in FIGS. 1 and 4 to 6, the surface 20 provides a shoulder disposed above the upper clip portion B that engage beneath the external chime, flange, bead or rim 24 on a can to efficiently support such a can.

It is believed clear that the size and shape of the hand gripping portion will keep the users hand out of contact with a can. The plastic material is such that a cold can of a beverage will not lose its cold as rapidly as if the can were held by hand alone.

Figure 5:
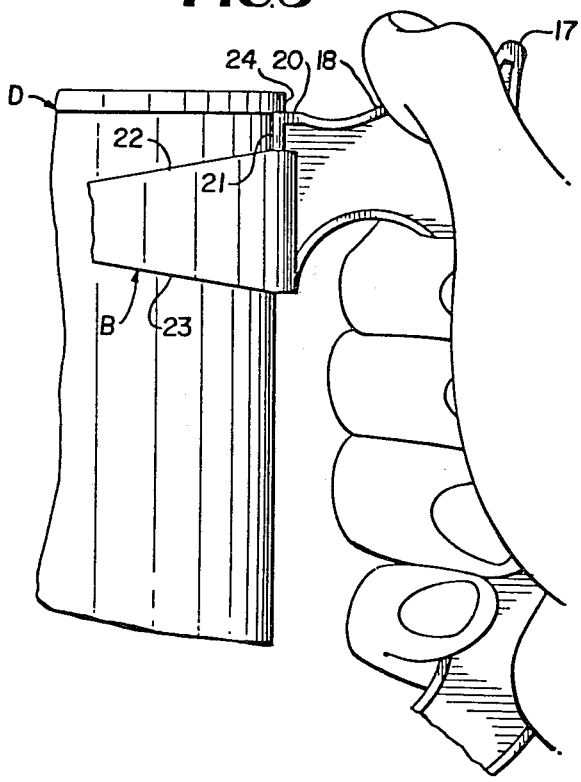
Figure 6:
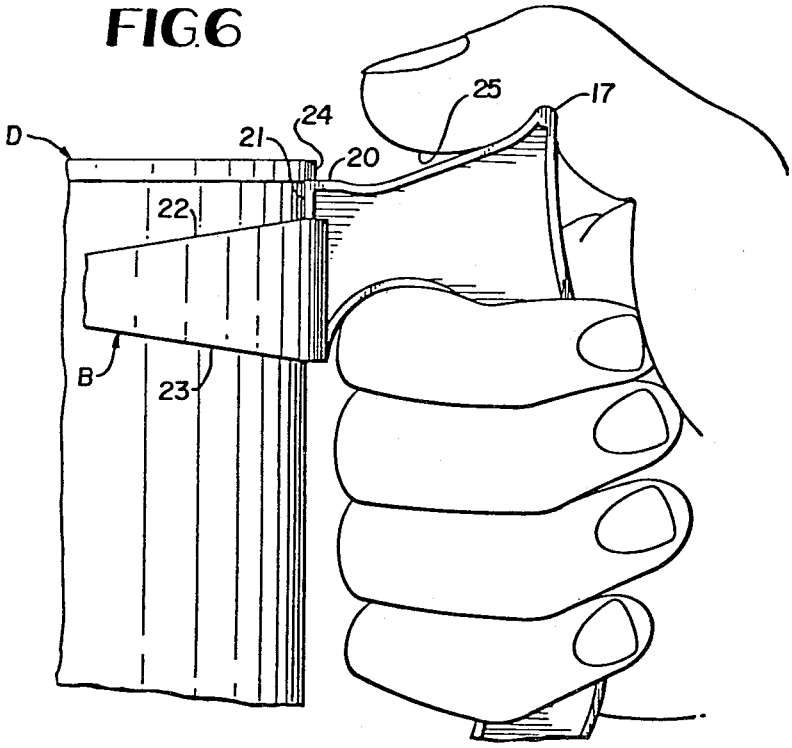

The inclined surface portion 18 provides a comfortable thumb rest during drinking of a beverage as indicated in FIG. 5 and the elevated tip portion 17 cooperates with the under surface 25 of a users thumb when the holder is associated with a can and the contents thereof are to be poured from a can, see FIG. 6. This feature provides more sensitive control over dispensing the contents. If desired, a user can place the under surface in either hand.

What is claimed is:

1. A one-piece detachable holder for beverage cans integrally molded of a plastic material comprising a substantially U-shaped hand gripping portion including upper and lower legs, a resilient arcuate can engaging clip extending from each leg and each encompassing the can outer surface more than 180° about an arcuate inner clip radius substantially equal but slightly less than the outer radius of a can to be held, said upper leg having an integral upstanding shoulder surface about its associated clip for engagement of the can outer surface beneath an external flange on a can to be held and extending downwards to merge with the upper surface of the clip for engaging the outer surface of said cans therewith over a vertical surface extending from said shoulder surface downwardly through the can engaging clip.

2. A detachable holder as claimed in claim 1 wherein said resilient clips include free ends and side surfaces tapering inwardly from the legs of said hand gripping portions toward their free ends.

3. A detachable holder for beverage cans comprising a substantially U-shaped hand gripping portion comprising upper and lower legs and a body connecting the legs in spaced apart relation, a resilient arcuate clip extending from each leg and each encompassing more than (180°) of a can to be held, said legs, body and clips comprising an integral holder, said resilient clips including free ends and side surfaces tapering inwardly from the legs of said hand gripping portion toward their free ends; said upper leg comprising a shoulder surface above, and in spaced apart relation with, its associated clip for engagement beneath an external flange on a can to be held; said upper leg of said hand gripping portion further comprising an upper surface inclined primarily upwardly from said shoulder and terminating in a rounded tip disposed in a plane above the plane of the top of a can to be held so that said upper surface and tip provide a thumb rest during drinking from a held can and said upper surface provides a thumb control surface during dispensing the contents thereof, respectively; said body portion and said legs each being of I-beam cross-section comprising a central web and oppositely directed perimetrical flanges having an extent several times the thickness of said web so that the surfaces of said web provide recessed indicia-accommodating surfaces protected by said flanges; said body aligning substantially parallel to a can being gripped by the clips; and said body having finger recesses therein outlined by the perimetrical flange along its inner edge; and said holder comprises an integrally molded plastic one-piece structure characterized by thermal insulation properties.

* * * * *